US009808059B2

(12) United States Patent
Szal

(10) Patent No.: US 9,808,059 B2
(45) Date of Patent: Nov. 7, 2017

(54) NOVELTY SUBMARINE EYEWEAR CASE

(71) Applicant: Tlmothy N Szal, Newton, MA (US)

(72) Inventor: Tlmothy N Szal, Newton, MA (US)

(73) Assignee: Babiators, LLC, Atlanta, GA (US)

( * ) Notice: Subject to any disclaimer, the term of this patent is extended or adjusted under 35 U.S.C. 154(b) by 312 days.

(21) Appl. No.: 14/719,641

(22) Filed: May 22, 2015

(65) Prior Publication Data

US 2016/0128441 A1 May 12, 2016

Related U.S. Application Data

(60) Provisional application No. 62/002,218, filed on May 23, 2014.

(51) Int. Cl.

| | |
|---|---|
| ***A45C 11/04*** | (2006.01) |
| ***B65D 73/00*** | (2006.01) |
| ***A63H 23/10*** | (2006.01) |
| ***A45C 15/00*** | (2006.01) |
| *B65D 81/36* | (2006.01) |

(52) U.S. Cl.

CPC ..... *A45C 11/04* (2013.01); *A45C 15/00* (2013.01); *A63H 23/10* (2013.01); *B65D 81/365* (2013.01)

(58) Field of Classification Search

CPC ..... A45C 11/04; A45C 11/005; A45C 15/00; B65D 81/365

USPC ..... 206/5, 6, 457

See application file for complete search history.

(56) References Cited

U.S. PATENT DOCUMENTS

| | | | | |
|---|---|---|---|---|
| 3,354,576 | A * | 11/1967 | Gralnick | A47B 61/00 206/457 |
| 4,961,717 | A * | 10/1990 | Hickey | A46B 5/0095 206/457 |
| 5,929,967 | A * | 7/1999 | Conner | A45C 11/04 206/5 |
| 6,065,595 | A * | 5/2000 | Ratcliff | A01K 97/06 206/457 |
| 6,851,552 | B1 * | 2/2005 | Chao | A45C 11/04 206/5 |
| 7,458,456 | B2 * | 12/2008 | Hogan | A45C 11/005 206/5 |
| 8,556,413 | B2 * | 10/2013 | Hogan | A45C 11/04 351/63 |

* cited by examiner

*Primary Examiner* — Luan K Bui

(74) *Attorney, Agent, or Firm* — Ascentage Patent Law, LLC; Travis Lee Johnson; David S. Einfeldt

(57) ABSTRACT

A novelty submarine eyewear case being configured to receive and protect an article of eyewear. The case can be translucent and be configured to be stackable one on another for display purposes. The case can also be configured to have a density being greater than water such that it can be used as a diving toy resembling a submarine.

16 Claims, 8 Drawing Sheets

NOVELTY SUBMARINE EYEWEAR CASE

PRIORITY

This application claims priority to co-pending U.S. Provisional Patent Application 62/002,218 entitled Novelty Submarine Eyewear Case, being filed on May 23, 2014, and is hereby incorporated by reference in its entirety.

COPYRIGHT STATEMENT

A portion of the disclosure of this patent application document contains material that is subject to copyright protection including the drawings. The copyright owner has no objection to the facsimile reproduction by anyone of the patent document or the patent disclosure as it appears in the Patent and Trademark Office file or records, but otherwise reserves all copyright rights whatsoever.

BACKGROUND

Various cases have been previously developed which are capable of containing and protecting eyewear. These cases are often employed to prevent the scratching and/or crushing of eyewear during transport or when the eyewear is otherwise not being actively used. Such cases can include soft cloth pouches which can provide some scratch protection but provide less crushing protection. These soft cases can however provide other benefits, for example, soft cases can provide a secondary use wherein the case can be used as a cleaning cloth. These soft cases are also typically easily storable in a pocket while not containing the eyewear which can often be viewed as an advantage. Alternatively, hard sided cases can provide better protection against crushing and scratching or otherwise protecting the eyewear and are typically relatively durable, however, these cases are less easily stowed while the eyewear is in use.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

DETAILED DESCRIPTION

Figure 1:
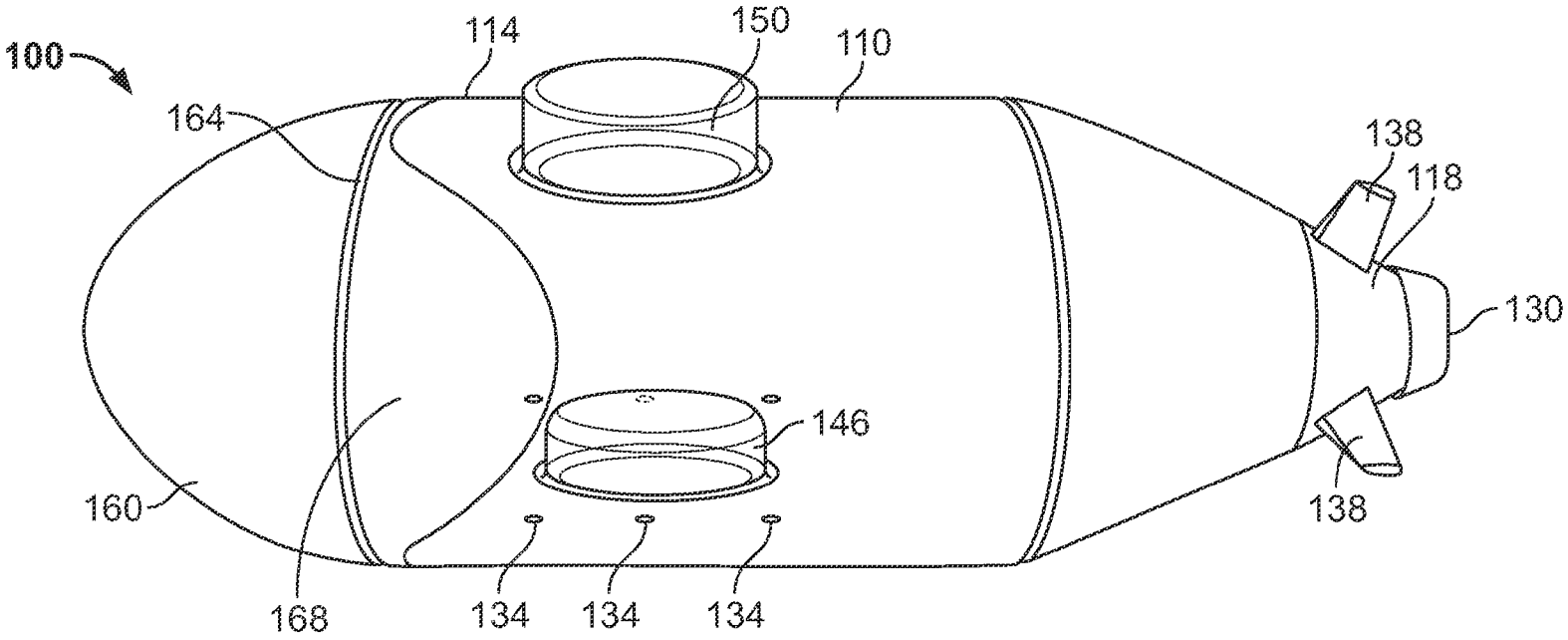
FIG. 1 illustrates a partially transparent side view of a novelty submarine eyewear case in accordance with an embodiment of the present invention.
Figure 2:
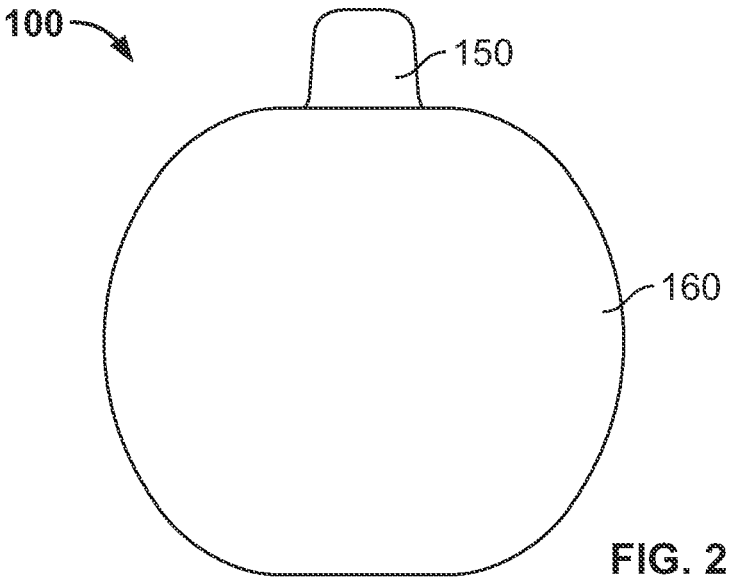
FIG. 2 illustrates a front end view of a novelty submarine eyewear case in accordance with the embodiment of FIG. 1.
Figure 3:
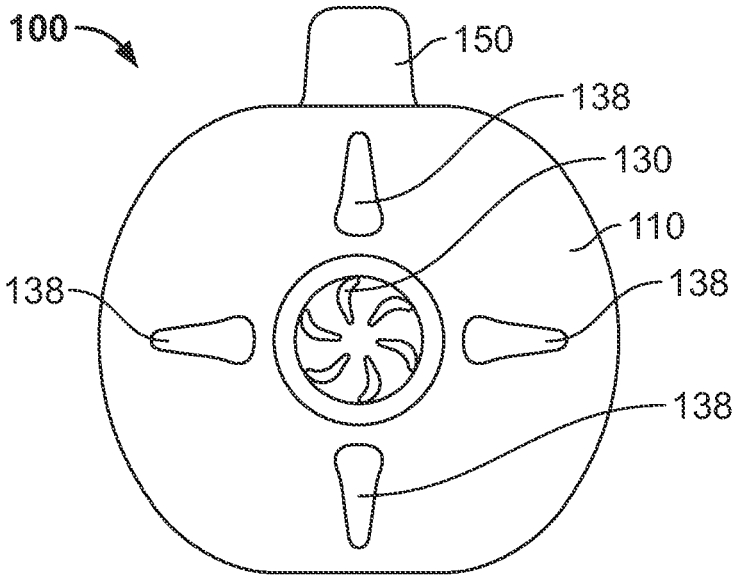
FIG. 3 illustrates a rear end view of a novelty submarine eyewear case in accordance with the embodiment of FIG. 1.
Figure 4:
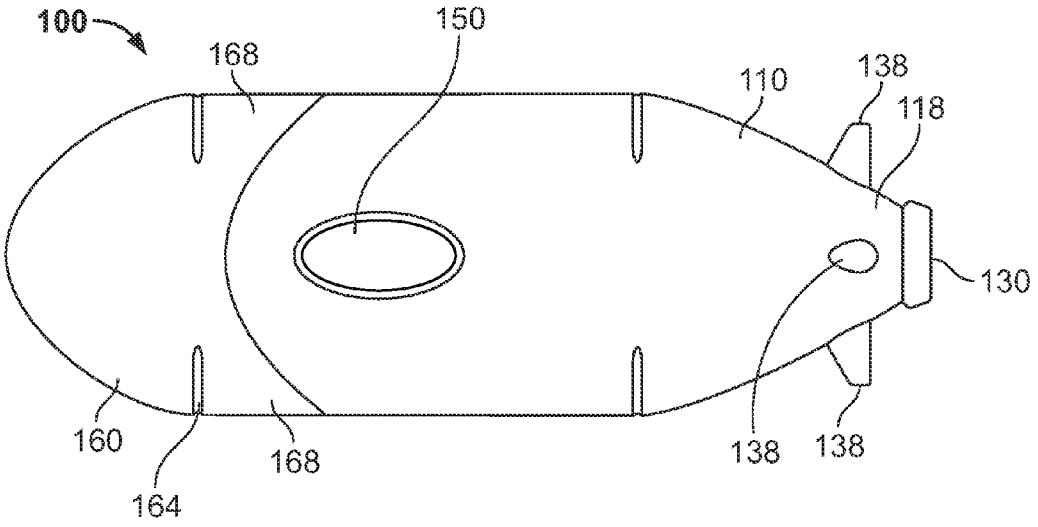
FIG. 4 illustrates a top view of a novelty submarine eyewear case in accordance with the embodiment of FIG. 1.
Figure 5:
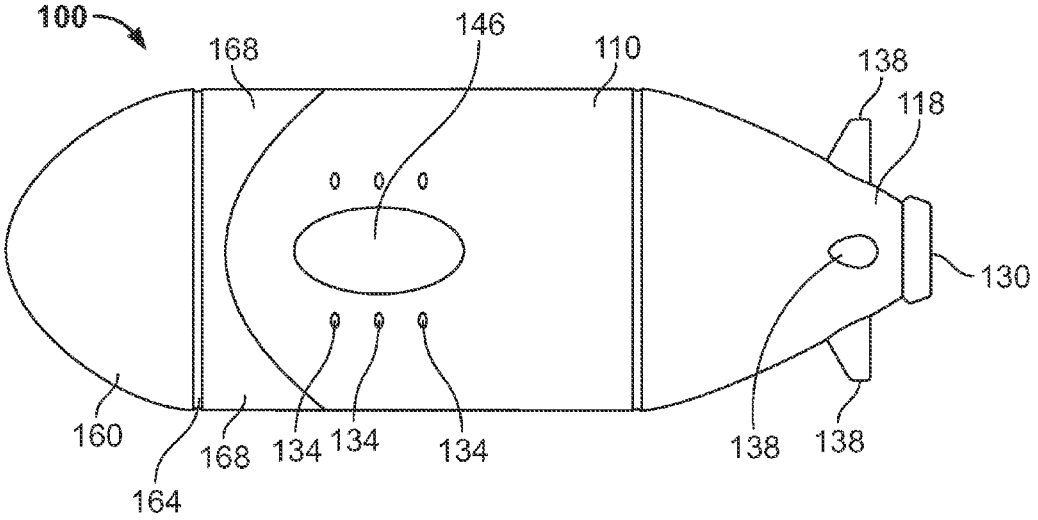
FIG. 5 illustrates a top view of a novelty submarine eyewear case in accordance with the embodiment of FIG. 1.
Figure 6:
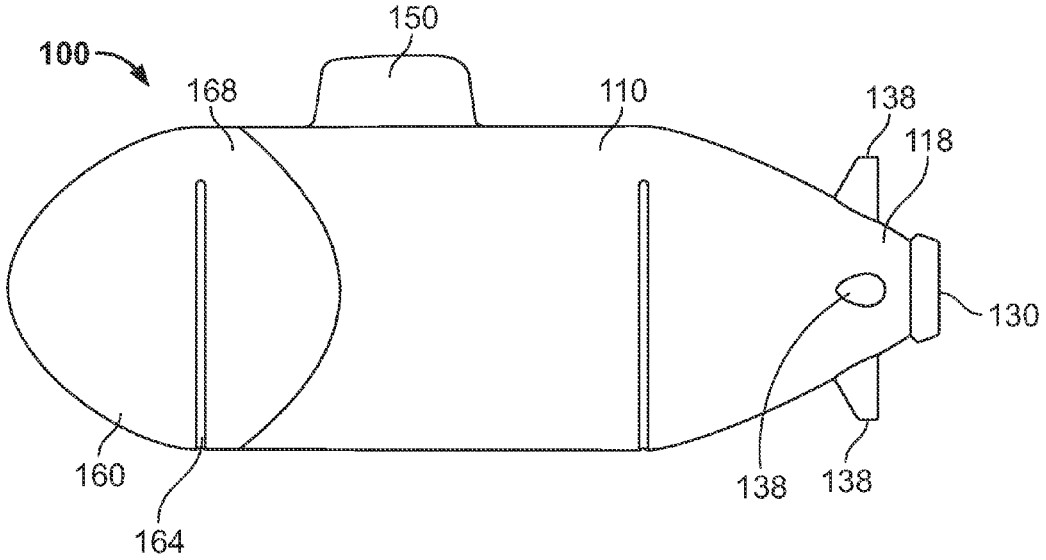
FIG. 6 illustrates an opaque closed side view of a novelty submarine eyewear case in accordance with the embodiment of FIG. 1.
Figure 7:
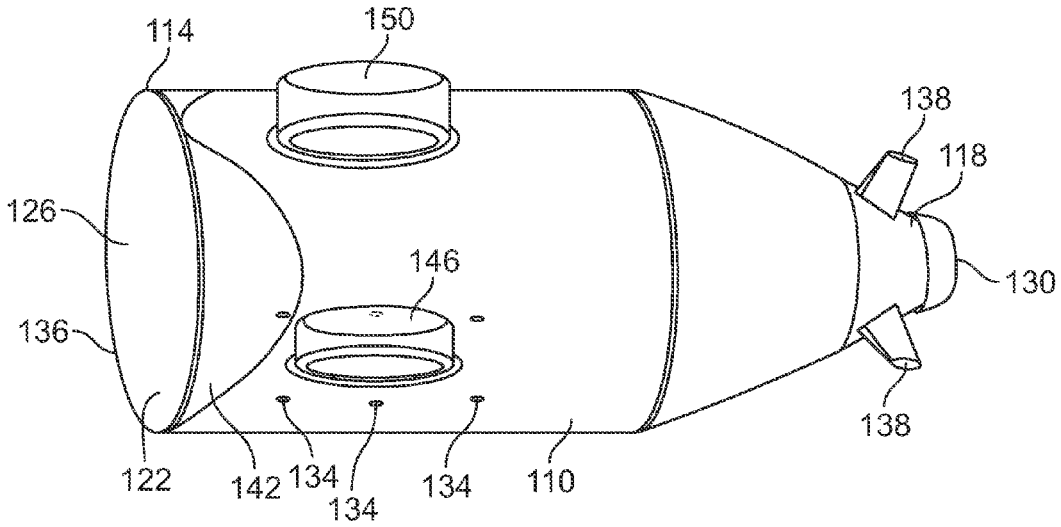
FIG. 7 illustrates a partially transparent open side view of a main body of the submarine eyewear case in accordance with the embodiment of FIG. 1.
Figure 8:
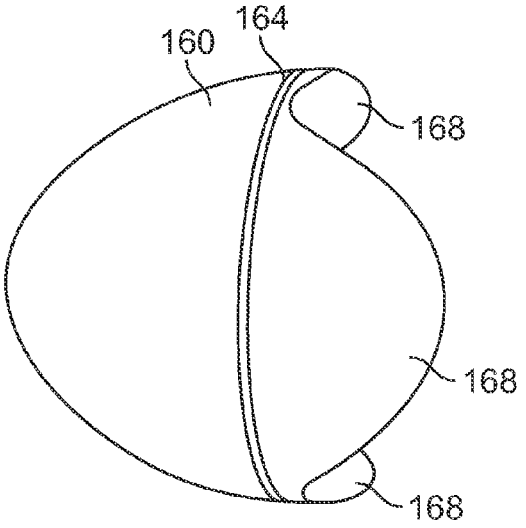
FIG. 8 illustrates a partially transparent open side view of a cap of the submarine eyewear case in accordance with the embodiment of FIG. 1.
Figure 9:
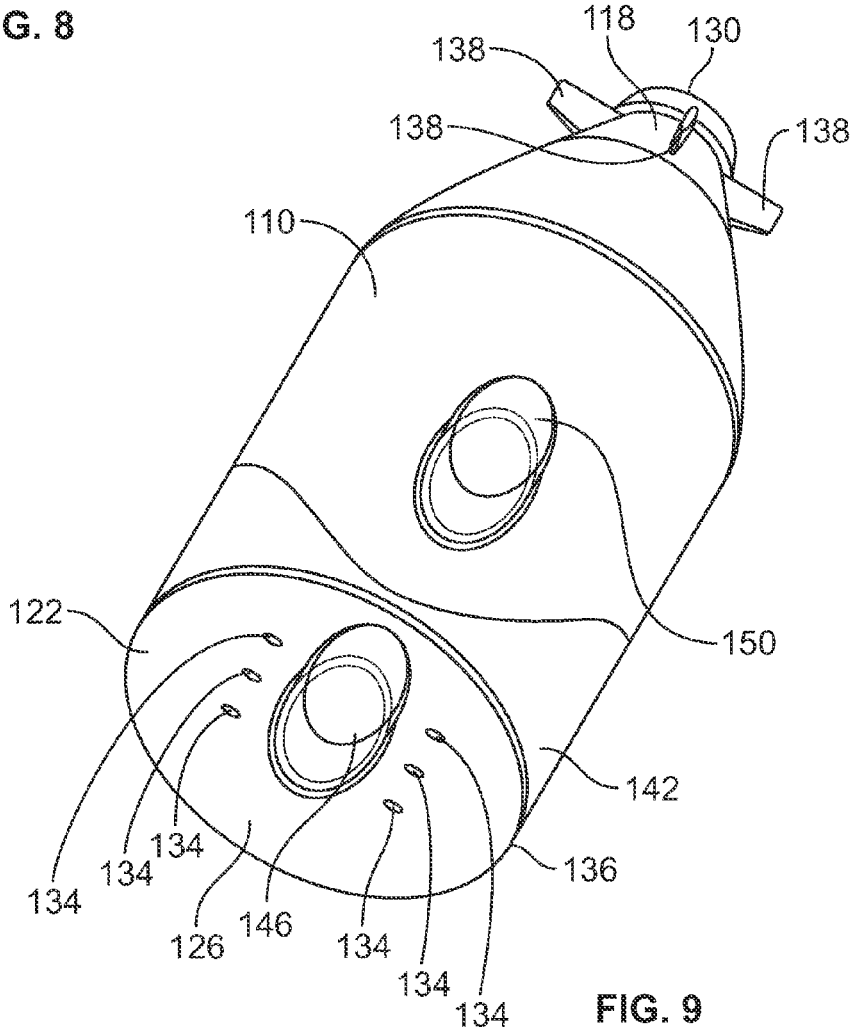
FIG. 9 illustrates a front isometric view of a main body of the submarine eyewear case in accordance with the embodiment of FIG. 1.
Figure 10:
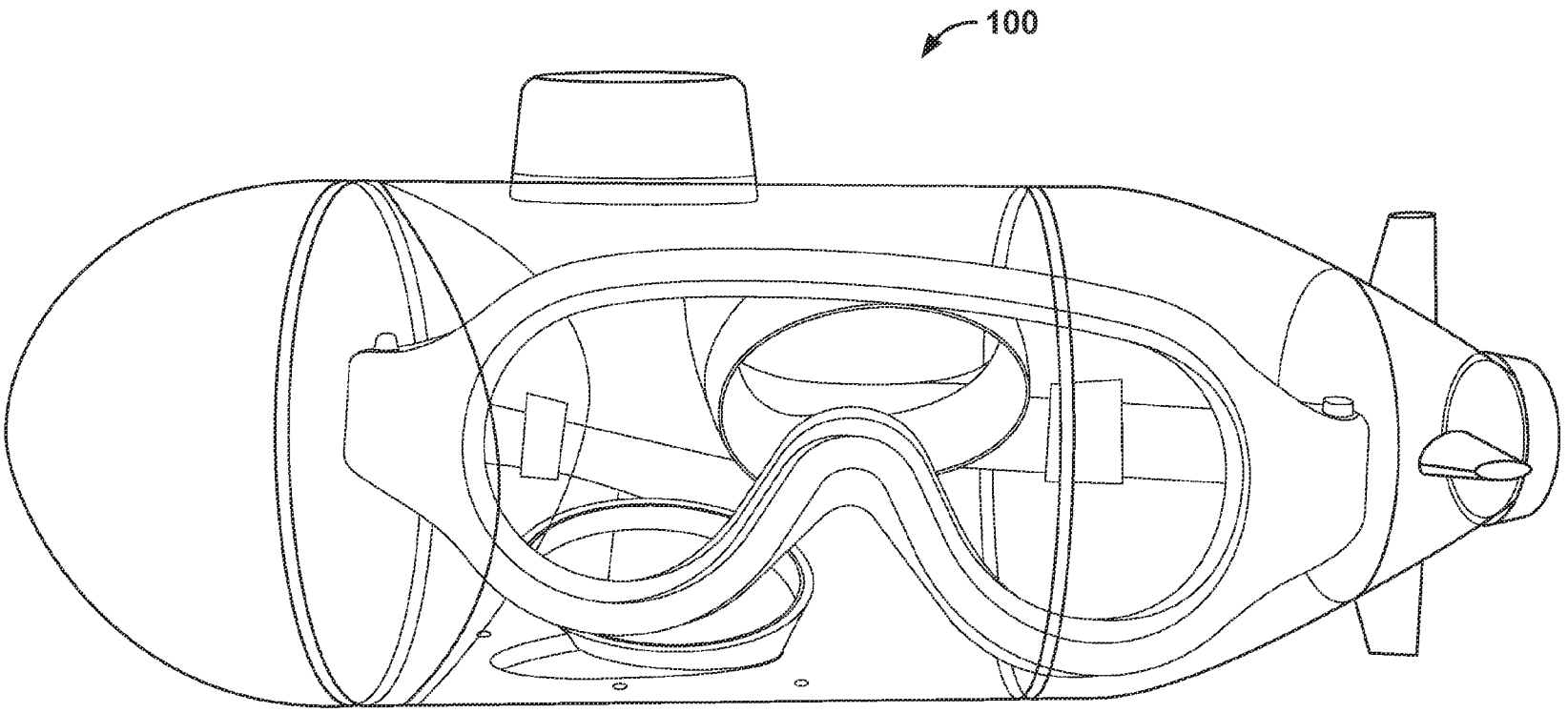
FIG. 10 illustrates how the novelty submarine eyewear case of the embodiment of FIG. 1 can be utilized to carry goggles.
Figure 11:
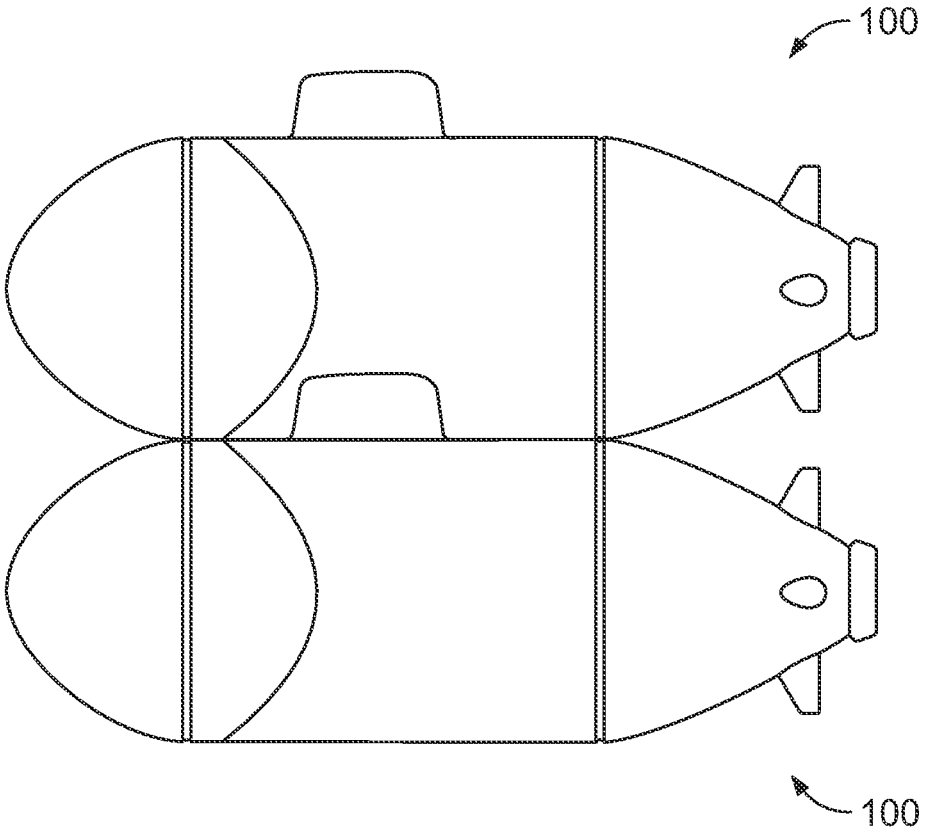
FIG. 11 illustrates how multiple novelty submarine eyewear cases can be stacked for display purposes.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

As discussed above, eyewear cases are often used to protect eyewear of a user during transport or storage. While soft fabric type cases are capable of providing some measure of scratch resistance and are easily compacted for storage when the eyewear is removed for use, they do not provide any protection against crushing of the eyewear contained therein. Hard cases provide the best protection against scratching and crushing during transport or storage of eyewear, however they do not typically compress when the eyewear is removed, and therefore the case itself can be burdensome to store when the eyewear is in use.

One such situation which can present a difficult storage situation for the case is when is used as a protective case for swimming or scuba goggles. In such situations users are typically wearing swimwear with limited or non-existent pocket space, and typically a backpack or other storage means is not feasible. One aspect of the present invention is to provide a hard case which doubles as a diving target item which a diver can dive after and retrieve from under the water. In this manner, the case provides a double use, both as a protective case for protecting the goggles when not in use, and by providing a diving target item which the user of the goggles can use when wearing the goggles thus eliminating some of the need to store the case when the goggles are in use.

Another aspect of the present invention is to provide a useful and stackable method of displaying goggles at a store in which they will be sold. The novelty submarine eyewear case is provided with nesting features which allow the cases to be stacked one upon another in a stable manner. In addition the case is provided with a translucent main body through which the contents can be viewed.

Various aspects of a novelty submarine eyewear case 100 is illustrated in FIGS. 1-12. These figures illustrate an eyewear case 100 which is sized and shaped so as to resemble a submarine and configured to receive at least one eyewear item within a cavity provided therein.

The novelty submarine eyewear case 100 can comprise a main body 110 having a front end 114 and a rear end 118 wherein a primary opening 122 is provided at the front end 114. The main body 110 can further include an internal cavity 126 sized and shaped to receive a piece of eyewear through the primary opening 122. The internal cavity 126 can be provided by forming the main body 110 to have an annular structure with a thin exterior wall. The main body 110 can also have a substantially cylindrical structure wherein the rear end 118 tapers to a smaller cross section and comes nearly to a point.

At the point of the rear end 118, a secondary opening 130 can be provided, as well as a plurality of apertures 134 formed in the bottom of the main body 110. Also provided at the rear end 118 are a plurality of fins 138 which give the main body 110 the appearance of the fuselage of a submarine.

A cap 160 which corresponds in size and shape to the primary opening 122 of the main body 110 can be provided and configured to close and seal the primary opening 122 of the main body 110. The cap 160 can have a semi-spherical or coned shape which resembles the appearance of the nose of a submarine. The internal surface of the cap 110 can be provided with a raised lip which works in conjunction with a corresponding lip on the main body so as to provide a snap fit or an interference fit in order to hold the cap 160 onto the main body 110.

When the cap 160 is provided to the main body 110, the assembly therefore resembles a complete submarine. When placed on a body of water, the water can enter through the plurality of apertures 130 which form passageways into the internal cavity 126 of the main body 110. The entering water will then displace air from inside the internal cavity and force said air out of the secondary opening 130, which then acts like a nozzle in the form of bubbles. The secondary opening 130 can be provided as a plurality of openings which are shaped in the form of a propeller to further provide the resemblance of a full submarine.

It can be appreciated that the bottom of the novelty submarine eyewear case can be provided with a series of weights or ballasts which ensure that the novelty submarine eyewear case remains upright when floating on the water, so that the plurality of apertures 130 remain submerged. It will also be appreciated that the novelty submarine eyewear case should also be formed of a material which has a greater density than water so that when placed into the water, the novelty submarine eyewear case sinks, albeit slowly, into the water. In addition, the novelty submarine eyewear case 100 can be provided having increased density, or be provided with additional weight or ballasts at a bottom portion of the main body, such that the novelty submarine eyewear case 100 will float in an upright position when placed in water. The novelty submarine eyewear case 100 can also be configured such that the cap 160 and the front end 114 have a greater density or more weight or ballasts provided therein such that the novelty submarine eyewear case 100 will sink slowly into water with the front end angled slightly downward in a diving configuration as water enters through the apertures 134 and air exits the secondary opening 130.

The cap can be provided with an interior raised edge 164 which abuts against the outer rim 136 of the primary opening 122. When the outer rim 136 abuts against the interior raised edge 164 a seal is created which prevents water from entering, or air from exiting from, the interior cavity 126 except water in through the plurality of apertures 134 and air out through the secondary opening 130. In order to provide a better gripping surface and increase the effectiveness of the seal between the cap 160 and the main body 110 there are provided a plurality of contoured extensions 168 located about a rim of the cap. The plurality of contoured extensions 168 correspond in shape to a plurality of contoured recesses 142 located on the main body 110, wherein the contoured extensions 168 fit within the contoured recesses 142 when the cap 160 is placed over the primary opening 122 of the main body 110.

In addition to providing a small amount of propulsion through the controlled displacement of air, the secondary opening 130 and plurality of apertures 134 provide airflow when wet goggles are placed in the main body 110 after use. Such airflow can allow for the goggles to better dry, and water to drip out of apertures 134 and allow fresh dry air to enter the main body 110.

The main body 110 is further provided with an indentation feature 146 formed in the bottom of the main body extending from a bottom surface of the main body and into the internal cavity 126. In addition, a protrusion 150 can be formed in a top of the main body 110 which corresponds in size and shape to the indentation feature 146. The protrusion 150 can extend from a top surface of the main body away from the internal cavity. The protrusion can be configured to enter into and form an interference fit with an indentation feature of another novelty submarine eyewear case. In this manner a plurality of such novelty submarine eyewear cases can be stacked one upon another for in store display purposes. It will also be appreciated that for such display purposes, the novelty submarine eyewear cases can be formed of a clear plastic or polymer, wherein the goggles, or other items, contained therein can be easily viewed from outside the novelty submarine eyewear case. The protrusion 150 and the indentation feature 146 can be formed in any shape, however an annular ellipsoid gives the best resemblance to a hatch of a real submarine, while still providing resistance to twisting between adjacent novelty submarine eyewear cases when stacked together. In order to provide the interference or snap fit between adjacent novelty submarine eyewear cases the indentation feature 146 can be provided with an internal channel and the protrusion 150 provided with a corresponding lip, so that when pressed together the two fit together and resist separating.

Figure 12:
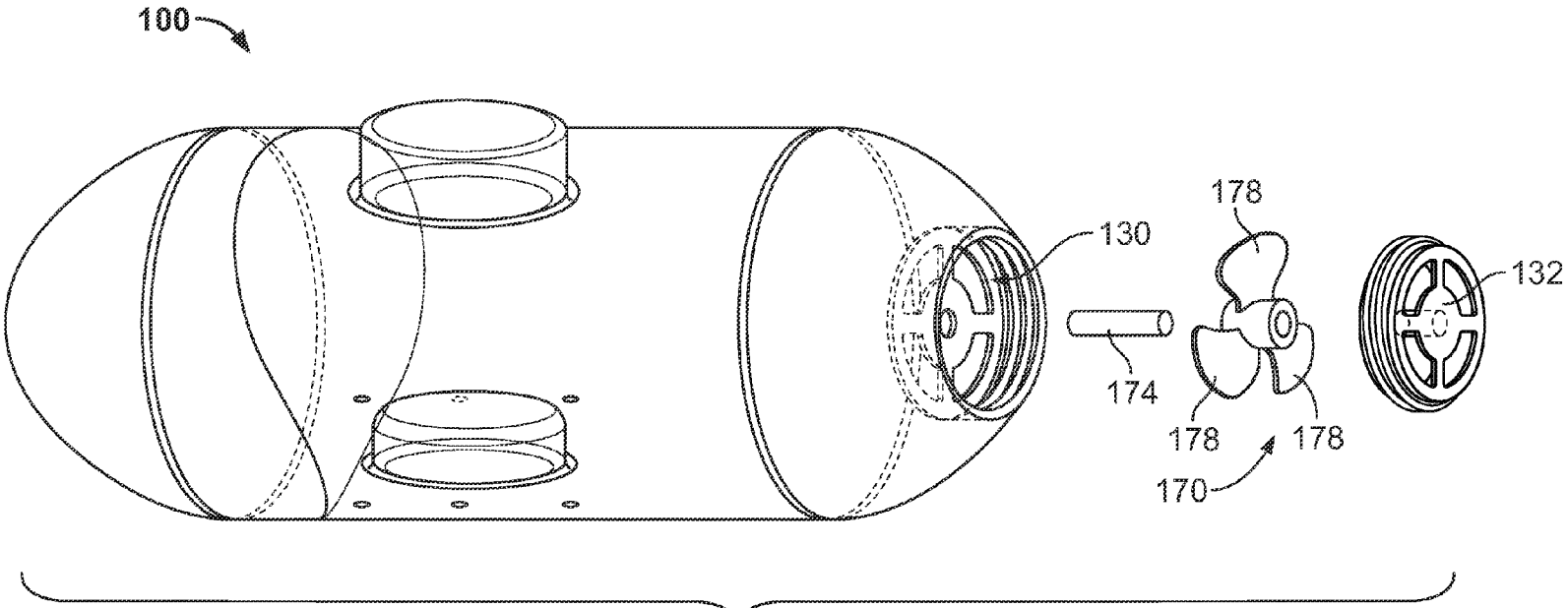
FIG. 12 illustrates a rear view of a novelty submarine eyewear case in accordance with one aspect of the present invention which illustrates a rotating propeller.

In accordance with another aspect of the present invention, a method of utilizing a novelty submarine eyewear case is provided which can include various steps. A first step can include storing a piece of eyewear within the novelty submarine eyewear case. When the goggles contained within the eyewear case are needed, the cap can be removed from a main body of the novelty submarine eyewear case, and the goggles can then be removed from the novelty submarine eyewear case. After the goggles are removed, the cap can then be replaced, and the case used as a swimming novelty or diving target item, wherein the novelty submarine eyewear case can then be placed into a body of water such that water enters through the apertures formed on the bottom of the main body and displaces air out of the secondary aperture formed in a rear end of the main body. In this manner, the air exiting the secondary aperture will provide bubbles and a certain degree of propulsion to the novelty submarine eyewear case, and the user can watch the bubbles and or dive to retrieve the novelty submarine eyewear case FIG. 12 illustrates a rear view of a novelty submarine eyewear case 100 in accordance with the various aspects of the present invention, however this view illustrates an alternative embodiment of a secondary opening 130 which can include an secondary cap 132 and rotatable propeller 170 which can be caused to spin by air or water traveling through the secondary opening 130. The secondary cap 132 can be utilized so as to sandwich a rotatable propeller 170 between the cap 132 and a main body of the novelty submarine eyewear case 100. The rotatable propeller 170 can include a rotating shaft 174 and a plurality of propeller blades 178. The rotating shaft 174 can be configured so as to have one portion of the shaft enter into a corresponding hole provided on the main body of the novelty submarine eyewear case 100 and another portion of the shaft be configured to enter into a corresponding hole provided in the secondary cap 132 such that rotating shaft 174 can spin within the holes thus allowing the propeller blades 178 to freely spin between the cap 132 and the main body of the novelty submarine eyewear case 100.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A novelty submarine eyewear case comprising:

a main body having a front end and a rear end wherein a primary opening is provided at the front end, the main body further comprising an internal cavity sized and shaped to receive a piece of eyewear through the primary opening;

a cap corresponding in size to the primary opening of the main body, wherein the cap is configured to close and seal the primary opening of the main body;

at least one secondary opening located about the rear end of the main body being shaped and sized to resemble a propeller; and one or more apertures being formed in a bottom portion of the main body which form a plurality of passages into the internal cavity.

2. The novelty submarine eyewear case of claim 1, wherein the main body and the cap are formed of a material having a density being greater than that of water.

3. The novelty submarine eyewear case of claim 1, further comprising:

a plurality of fins located about the rear end of the main body.

4. The novelty submarine eyewear case of claim 1, further comprising:

an indentation feature formed in the bottom portion of the main body extending from a bottom surface of the main body and into the internal cavity; and a protrusion formed in a top of the main body corresponding in size and shape to the indentation feature, the protrusion extending from a top surface of the main body away from the internal cavity.

5. The novelty submarine eyewear case of claim 1, further comprising:

a plurality of contoured recesses located on an outer surface of the main body about the primary opening; and a plurality of contoured extensions located about a rim of the cap, the plurality of contoured extensions corresponding in shape to the plurality of contoured recesses of the main body, wherein the contoured extensions fit within the contoured recesses when the cap is placed over the primary opening of the main body.

6. The novelty submarine eyewear case of claim 1, wherein the front end and the cap together have a weight and density being higher than the rear end of the main body such that the front end and cap sink first when placed into water.

7. The novelty submarine eyewear case of claim 6, wherein the bottom portion of the main body is heavier than a top portion.

8. The novelty submarine eyewear case of claim 1, further comprising a movable propeller provided about the at least one secondary opening.

9. A novelty submarine eyewear case system, the system comprising:

one or more main bodies, each main body having a front end and a rear end wherein a primary opening is provided at the front end, the main body further comprising an internal cavity sized and shaped to receive a piece of eyewear through the primary opening;

each main body having a corresponding cap corresponding in size to the primary opening of its respective main body, wherein the cap is configured to close and seal the primary opening of its respective main body;

at least one secondary opening located about the rear end of each main body; and one or more apertures being formed in a bottom portion of each main body which form a plurality of passages into the internal cavity.

10. The novelty submarine eyewear system of claim 9, wherein each main body and corresponding cap are formed of a material having a density being greater than that of water.

11. The novelty submarine eyewear system of claim 9, further comprising:

an indentation feature formed in the bottom portion of each main body extending from a bottom surface of each main body and into the internal cavity of each main body; and a protrusion formed in a top of each main body corresponding in size and shape to the indentation feature, the protrusion extending from a top surface of each main body away from the internal cavity.

12. The novelty submarine eyewear system of claim 11, further comprising a plurality of main bodies wherein the protrusion of at least one main body is nested into and interferingly engaged with the indentation feature of at least one other main body.

13. The novelty submarine eyewear case of claim 12, further comprising:

a plurality of contoured recesses located on an outer surface of the main body about the primary opening; and a plurality of contoured extensions located about a rim of the cap, the plurality of contoured extensions corresponding in shape to the plurality of contoured recesses of the main body, wherein the contoured extensions fit within the contoured recesses when the cap is placed over the primary opening of the main body.

14. The novelty submarine eyewear case of claim 12, wherein the front end and the cap together have a weight and density being higher than the rear end of the main body such that the front end and cap sink first when placed into water.

15. The novelty submarine eyewear case of claim 12, further comprising:

a plurality of fins located about the rear end of the main body.

16. The novelty submarine eyewear system of claim 9, wherein the secondary opening of each main body is provided with a movable propeller.

* * * * *